US010463557B2

(12) United States Patent
Wakabayashi et al.

(10) Patent No.: US 10,463,557 B2
(45) Date of Patent: Nov. 5, 2019

(54) INCUBATOR

(71) Applicant: ATOM MEDICAL CORPORATION, Bunkyo-ku, Tokyo (JP)

(72) Inventors: Keisuke Wakabayashi, Saitama (JP); Masato Honda, Saitama (JP); Yutaka Sekiguchi, Saitama (JP); Ichiro Matsubara, Tokyo (JP); Terumi Matsubara, Tokyo (JP)

(73) Assignee: Atom Medical Corporation, Tokyo (JP)

( * ) Notice: Subject to any disclaimer, the term of this patent is extended or adjusted under 35 U.S.C. 154(b) by 188 days.

(21) Appl. No.: 15/347,147

(22) Filed: Nov. 9, 2016

(65) Prior Publication Data

US 2017/0135886 A1 May 18, 2017

(30) Foreign Application Priority Data

Nov. 18, 2015 (JP) ..... 2015-225774

(51) Int. Cl.
*A61G 11/00* (2006.01)

(52) U.S. Cl.
CPC ..... *A61G 11/006* (2013.01); *A61G 11/00* (2013.01); *A61G 11/005* (2013.01); *A61G 11/008* (2013.01); *A61G 2210/90* (2013.01)

(58) Field of Classification Search
CPC ..... A61G 11/006; A61G 11/005; A61G 2203/78; A61G 7/05; A61G 7/0507; A61G 7/0518; A47D 7/00
See application file for complete search history.

(56) References Cited

U.S. PATENT DOCUMENTS 6,292,980 B1 * 9/2001 Yi ..... H04M 1/0216 16/303
2012/0023659 A1 * 2/2012 Zerhusen ..... A61G 7/0506 5/12.1
2015/0128344 A1 * 5/2015 Hutchison ..... A47C 19/022 5/280

FOREIGN PATENT DOCUMENTS

JP 2012-223320 A 11/2012
JP 2014-33769 A 2/2014
JP 2014033769 A * 2/2014 ..... A61G 11/001

OTHER PUBLICATIONS

Office Action, and English language translation thereof, in corresponding Japanese Application No. 2015-225774, dated Dec. 20, 2016, 7 pages.

* cited by examiner

*Primary Examiner* — Kaylee R Wilson
(74) *Attorney, Agent, or Firm* — Brinks Gilson & Lione

(57) ABSTRACT

An incubator with minimal risk of a guard wall portion moving to an outer side if a child resting on a mattress tray pushes the guard wall portion toward the outer side from the inner side thereof. An attachment protrusion portion provided at the guard wall portion is engageable with an attachment recess portion provided at an outer periphery vicinity of the mattress tray. An engaging protrusion portion is provided at one of the attachment protrusion portion and the attachment recess portion, and an engaging hole portion is provided at the other of the attachment protrusion portion and the attachment recess portion. The engaging hole portion is engageable with the engaging protrusion portion.

10 Claims, 11 Drawing Sheets

INCUBATOR

RELATED APPLICATIONS

This application claims priority under 35 U.S.C. § 119 to Japanese Patent Application No. 2015-225774 filed on Nov. 18, 2015, the entire content of which is hereby incorporated by reference.

BACKGROUND

Technical Field

The present disclosure relates to an incubator that is provided with a mattress tray on which a child may be rested and with at least one guard wall portion that can enclose at least a portion of an outer periphery vicinity of the mattress tray.

Related Art

In an incubator (below referred to as "the incubator of Patent Reference 1") disclosed in Japanese Patent Application Laid-Open (JP-A) No. 2012-223320 (below referred to as "Patent Reference 1"), a mattress tray with a flattened container shape is disposed on an incubator base. A fixed wall portion (a "fixed baby guard") that generally structures a wall portion at the head side of a child, a leg side movable wall portion (a "movable baby guard") that generally structures a wall portion at the leg side of the child, a left side movable wall portion (a "movable baby guard") that generally structures a wall portion at a left side of the child, and a right side movable wall portion (a "movable baby guard") that generally structures a wall portion at the right side of the child are respectively disposed on the incubator base so as to form a substantially rectangular shape overall as seen in plan view. The one fixed baby guard and the three movable baby guards may have substantially rectangular shapes and be substantially transparent. A substantially cuboid-shaped child accommodation space of which an upper face is open is structured by the mattress tray (that is, a mattress on the mattress tray), the one fixed baby guard and the three movable baby guards. Substantially the whole of each of the three movable baby guards and the one fixed baby guard is structured by a substantially transparent plastic board. In a substantially upright state (below referred to as "the upright state"), each of the three movable baby guards is oriented substantially upward. The each movable baby guard is structured to be reciprocally turnable between the upright state and a state hanging substantially downward (below referred to as "the pendant state") by turning about turning shafts at both left and right sides or both front and rear sides of the movable baby guard. The turning shafts are disposed in vicinities of portions at the lower edge side of the movable baby guard in the upright state.

With the incubator of Patent Reference 1, in a state in which a child such as a neonatal infant or the like is rested on a mattress disposed on the mattress tray, a carer or the like may put one or more of the movable baby guards—the leg side movable baby guard, the left side movable baby guard and the right side movable baby guard—into the pendant state. Hence, no baby guard is present at one or more of the leg side of the child, the left side of the child and the right side of the child. Therefore, the child may be able to project their leg or arm out from the mattress tray. In extreme cases, there is a danger of the child projecting too far from the mattress tray and falling out of the incubator.

SUMMARY

The present invention has been devised to effectively solve the above-described problem of the incubator of Patent Reference 1 with a relatively simple structure.

An incubator according to a first aspect of the present invention includes: a mattress tray on which a child can be rested; and at least one guard wall portion capable of enclosing at least a portion of an outer periphery vicinity of the mattress tray, wherein at least one of the guard wall portion includes at least one first attachment protrusion portion and at least one second attachment protrusion portion, the mattress tray includes at least one first attachment recess portion for engaging with the at least one first attachment protrusion portion and at least one second attachment recess portion for engaging with the at least one second attachment protrusion portion, an engaging protrusion portion is provided at one of the first attachment protrusion portion and the first attachment recess portion for engaging with the first attachment protrusion portion, and an engaging hole portion that is engageable with the engaging protrusion portion is provided at the other of the first attachment protrusion portion and the first attachment recess portion. According to this structure, even if a child resting on the mattress tray pushes one or more of the guard wall portions toward the outer side from the inner side thereof with a hand, there is no particular risk of the guard wall portion moving toward the outer side. Therefore, there is no particular risk of the child causing the guard wall portion to fall down and hence of an arm or leg of the child projecting out from the mattress tray, or of the child projecting too far from the mattress tray and falling out of the incubator.

In a second aspect of the present invention, the at least one guard wall portion includes a guard wall portion at a front side, a guard wall portion at a left side and a guard wall portion at a right side. According to this structure, the above-described effect provided by the present invention may be more excellently provided.

In a third aspect of the present invention, the number of the at least one first attachment protrusion portion is one, the number of the at least one first attachment recess portion is one, the number of the at least one second attachment protrusion portion is two, and the number of the at least one second attachment recess portion is two. According to this structure, the above-described effect provided by the present invention may be comparatively excellently provided with a comparatively simple structure.

In a fourth aspect of the present invention, each first attachment recess portion and second attachment recess portion is disposed at an outer side face of the outer periphery of the mattress tray. According to this structure, because each first attachment recess portion and second attachment recess portion is disposed at the outer side face of the outer periphery of the mattress tray, the engaging protrusion portion engages with the engaging hole portion at the outer periphery of the mattress tray. Therefore, even if the guard wall portion is pushed outward, diagonally outward or the like by a hand, a foot or the like of a child resting on the mattress tray, a substantially upward displacement is blocked. Thus, the guard wall portion does not disengage from the mattress tray even in this situation.

In a fifth aspect of the present invention, a narrowing portion is provided at the second attachment recess portion, the narrowing portion preventing disengagement of the at least one second attachment protrusion portion substantially to sideward from the second attachment recess portion. According to this structure, an unintended displacement of the second attachment protrusion portion toward the outer side of the mattress tray may be substantially certainly blocked.

A sixth aspect of the present invention further includes at least one third attachment protrusion portion, wherein the mattress tray includes a side wall portion, and the third attachment protrusion portion includes a pendant portion that is abuttable against an inner side face of the side wall portion. According to this structure, a possibility of the guard wall portion being displaced toward the outer side may be further reduced.

In a seventh aspect of the present invention, in the sixth aspect, the number of the at least one third attachment protrusion portion is two. According to this structure, the above-described effect provided by the invention according to the fifth aspect of the present invention may be comparatively excellently provided with a comparatively simple structure.

An eighth aspect of the present invention, in the second aspect, further includes: a front side guard outer side wall portion provided at an outer side relative to the front side guard wall portion; a left side guard outer side wall portion provided at an outer side relative to the left side guard wall portion; a right side guard outer side wall portion provided at an outer side relative to the right side guard wall portion; and a rear side guard outer side wall portion that, together with the front side guard outer side wall portion, the left side guard outer side wall portion and the right side guard outer side wall portion, can structure a substantially cuboid-shaped child accommodation space, wherein the front side guard wall portion, the left side guard wall portion and the right side guard wall portion are provided at the inner sides of, respectively, the front side guard outer side wall portion, the left side guard outer side wall portion and the right side guard outer side wall portion, and each of the front side guard outer side wall portion, the left side guard outer side wall portion and the right side guard outer side wall portion is structured so as to be individually reciprocally turnable between a substantially upright state in which the same is oriented substantially upward and a substantially non-upright state in which the same is oriented substantially upward. According to this structure, the front side, left side and right side guard wall portions (that is, inner side wall portions) are disposed in a space substantially encircled by the front side, left side, right side and rear side guard outer side wall portions. Therefore, when a child is accommodated in the child accommodation space of the incubator, the child may be certainly and safely accommodated in the incubator by both the guard inner side wall portions and the guard outer side wall portions.

In a ninth aspect of the present invention, the incubator is an open-type incubator. According to this structure, the effects provided by each of the first through eighth aspects may be reliably provided with a comparatively simple structure.

The above and other objects, features and advantages of the present invention will become apparent from the following detailed descriptions, which should be read in conjunction with the accompanying drawings.

BRIEF DESCRIPTION OF THE DRAWINGS

Exemplary embodiments of the present invention will be described in detail based on the following figures, wherein.

DETAILED DESCRIPTION OF THE INVENTION

Now, an exemplary embodiment in which the present invention is applied to an open-type incubator (an "infant warmer") is described with reference to the drawings, in the sections "1. Overall schematic description of the incubator", "2. Description of outer side wall portion structures", "3. Structural description of inner side wall portion structures", and "4. Description of operations of the inner side wall portion structures".

—1. Overall Schematic Description of the Incubator—

Figure 1:
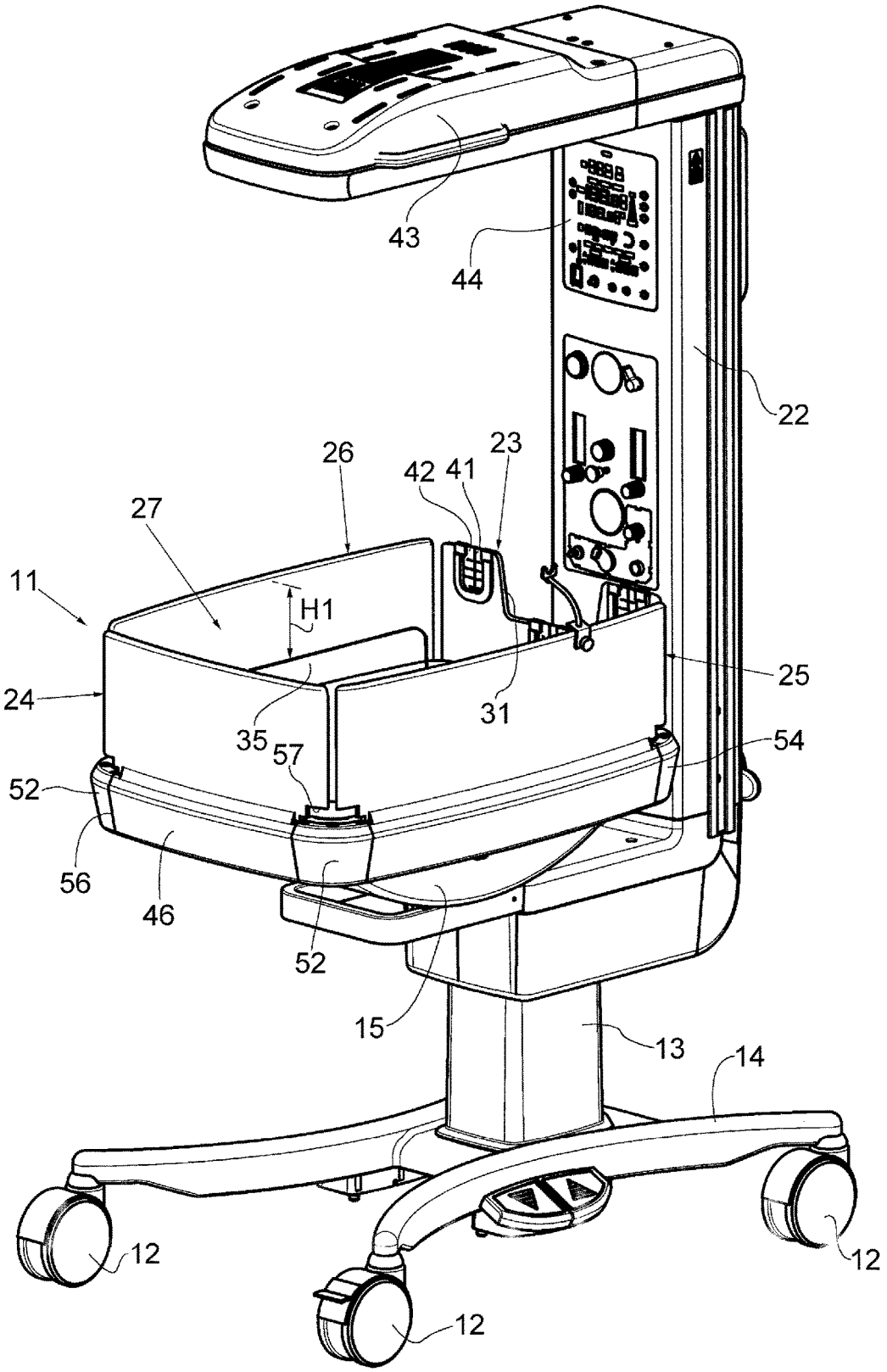
FIG. 1 is a perspective view of a usual usage state of an open-type incubator in accordance with an exemplary embodiment in which the present invention is applied.
Figure 2:
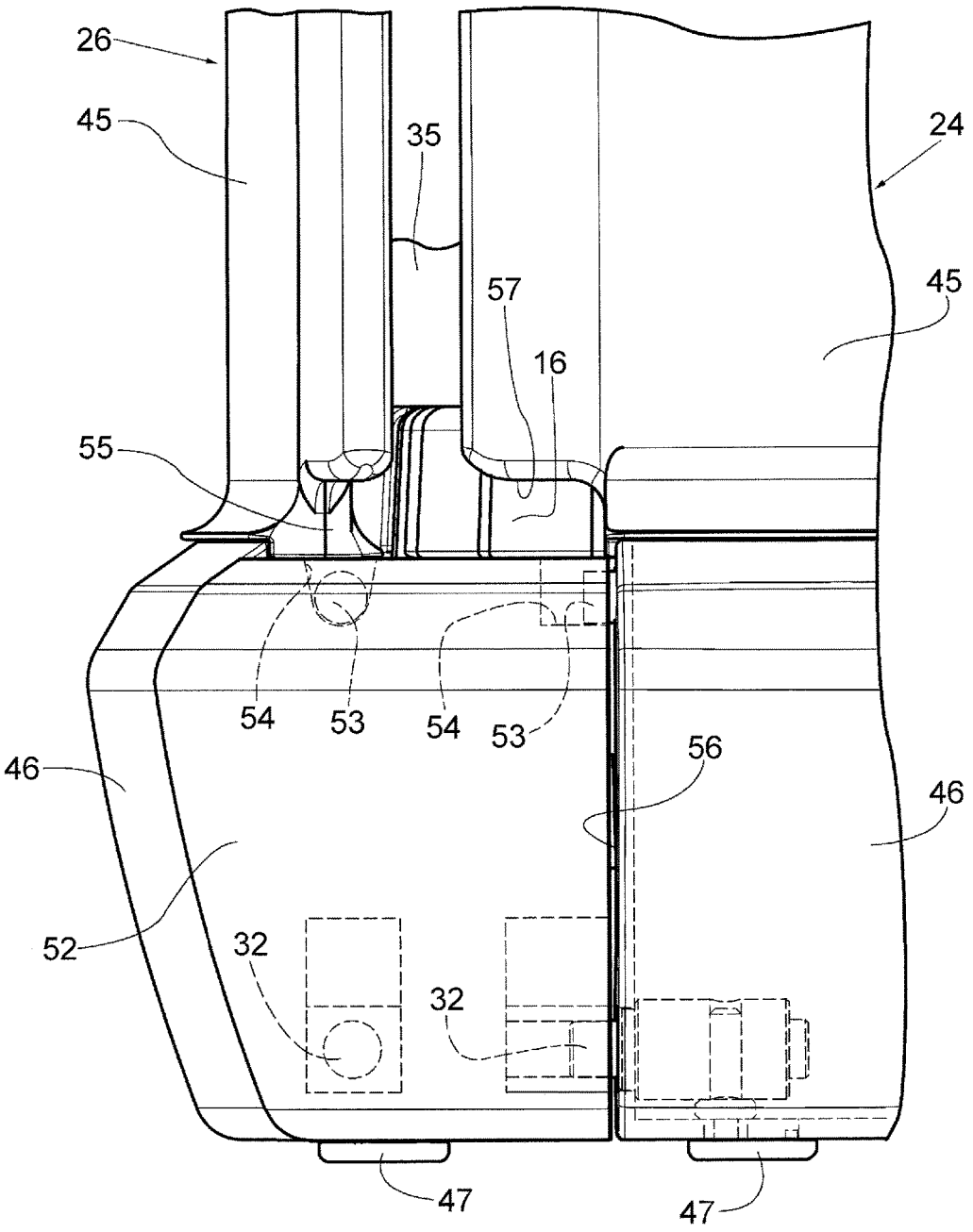
FIG. 2 is a side view of a vicinity of a lower portion of a corner portion at a front-left side of a child accommodation structure of the open-type incubator shown in FIG. 1, seen substantially in side view.
Figure 4:
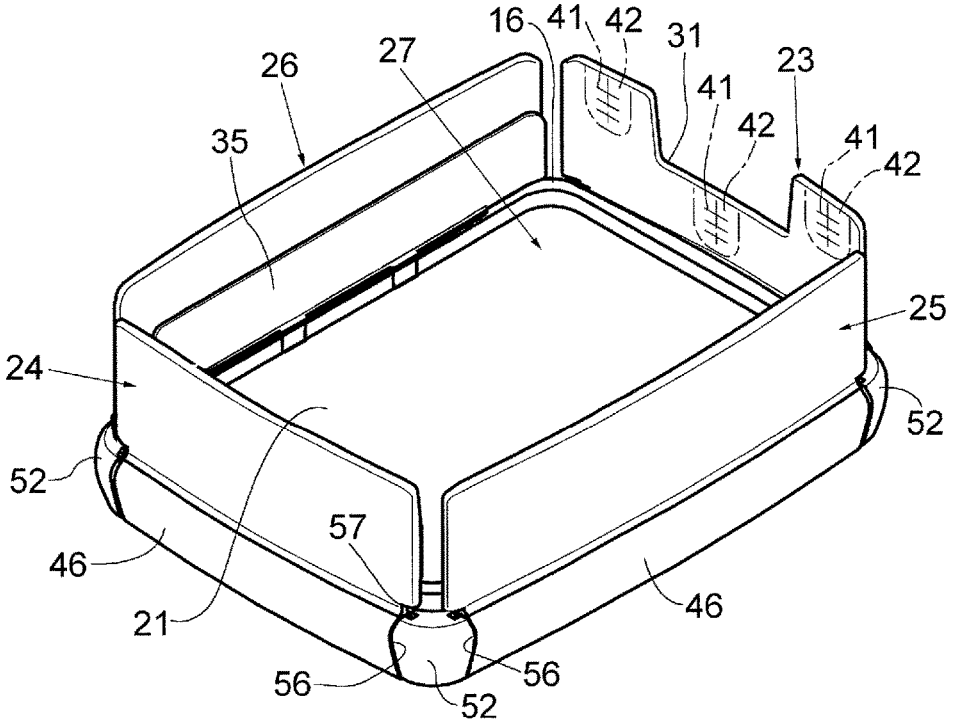
FIG. 4 is a perspective view of the child accommodation structure of the open-type incubator shown in FIG. 1.

As shown in FIG. 1, an open-type incubator 11 is provided with a trolley 14 to which wheels 12 and a main pillar 13 are attached. Specifically, the wheels 12 are attached below four corners of the trolley 14, and the main pillar 13 is mounted on the trolley 14. An incubator base 15 is disposed on the main pillar 13. As shown in FIG. 1, FIG. 2 and FIG. 4, a mattress tray 16 in a flattened container shape is disposed on the incubator base 15. The mattress tray 16 may have a substantially rectangular shape as seen in plan view. A mattress 21 on which a child such as a neonatal infant or the like can be rested may be disposed on the mattress tray 16. The mattress tray 16 overall is constituted of a plastic material such as an ABS resin or the like.

As shown in FIG. 1, FIG. 2 and FIG. 4, an outer side wall portion (that is, an outer side baby guard or guard outer side wall portion) 23 that generally structures an outer side wall portion at the head side of a child, an outer side wall portion (that is, an outer side baby guard or guard outer side wall portion) 24 that generally structures an outer side wall portion at the leg side of the child, an outer side wall portion (that is, an outer side baby guard or guard outer side wall portion) 25 that generally structures an outer side wall portion at a left side of the child, and an outer side wall portion (that is, an outer side baby guard or guard outer side wall portion) 26 that generally structures an outer side wall portion at the right side of the child are each provided at the mattress tray 16 that is fixedly attached to and disposed on the incubator base 15, so as to form a substantially rectangular shape overall as seen in plan view. The outer side wall portion 23 is disposed adjacent to an accessory support pillar 22 that is disposed on the main pillar 13. The outer side wall portions 23 to 26 may be formed in substantially rectangular shapes and may be substantially transparent. A child accommodation space 27 with a substantially cuboid shape of which the upper face is open is structured by the mattress tray 16 (that is, the mattress 21) and the outer side wall portions 23 to 26. The left side outer side wall portion 25 and the right side outer side wall portion 26 have substantially the same dimensions as one another. The outer side wall portion 23 and the outer side wall portion 24 are both somewhat smaller in length in length directions thereof (that is, horizontal directions) than each of the outer side wall portions 25 and 26. The outer side wall portion 23 and the outer side wall portion 24 may have substantially the same dimensions as one another, except that a recess portion 31 in a cutaway shape extends partway toward a lower edge portion of the outer side wall portion 23 from a substantially central region of an upper edge portion of the outer side wall portion 23.

Figure 3A:
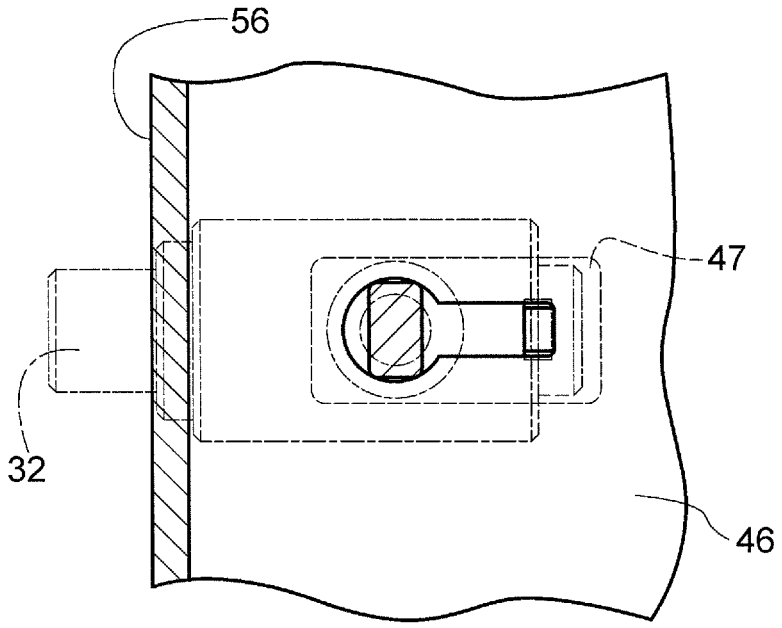
FIG. 3A is a partial horizontal sectional diagram of a state in which an operation member of a wall portion detachment operation mechanism shown in FIG. 2 has not been operated.
Figure 3B:
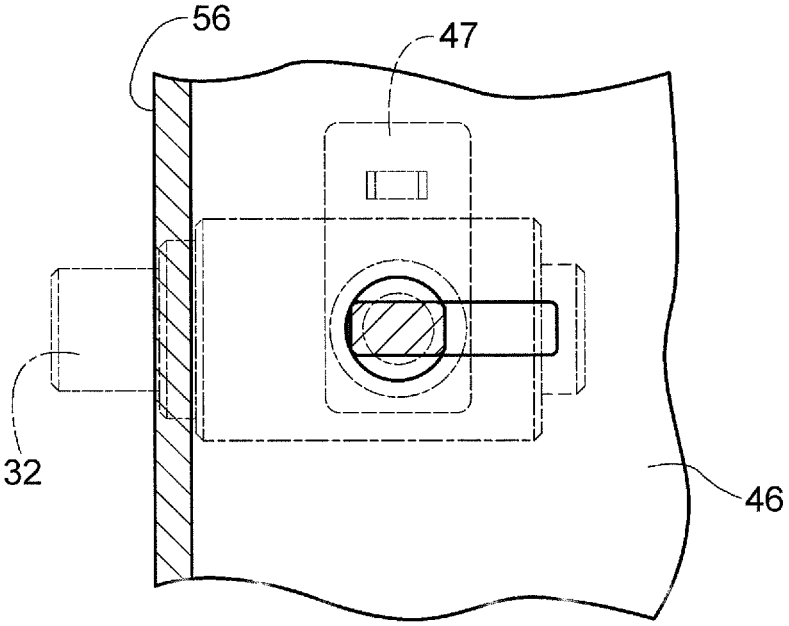
FIG. 3B is a horizontal sectional diagram similar to FIG. 3A of a first operated state of the operation member of the wall portion detachment operation mechanism shown in FIG. 3A.
Figure 3C:
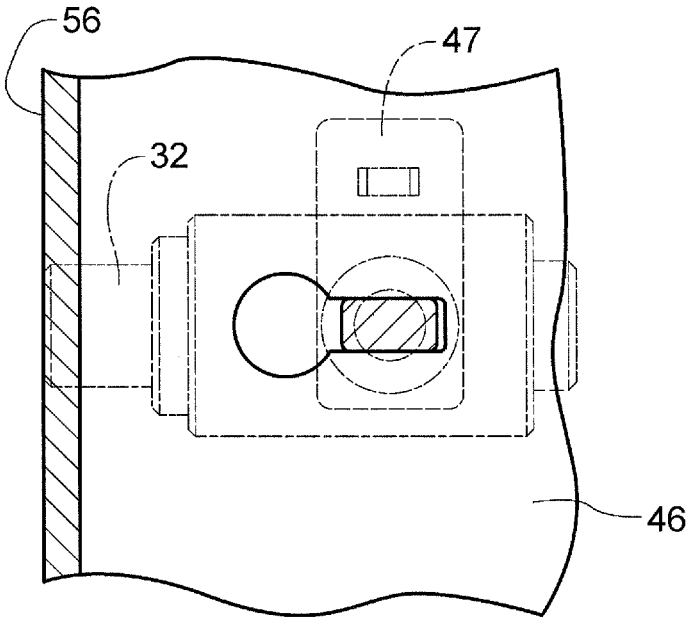
FIG. 3C is a horizontal sectional diagram similar to FIG. 3A of a second operated state of the operation member of the wall portion detachment operation mechanism shown in FIG. 3A.

Each of the outer side wall portions 23 to 26 shown in FIG. 1 may be substantially wholly structured in a resilient board shape of a substantially transparent plastic such as a substantially transparent polycarbonate resin, a substantially transparent acrylic resin or the like. Each of the outer side wall portions 24 to 26 is structured to be reciprocally turnable between a substantially upright state (below referred to as "the upright state") in which the outer side wall portion 24 to 26 is oriented substantially upward, as shown in FIG. 1 and FIG. 2, and a state shown in FIG. 5 in which the outer side wall portion 24 to 26 hangs substantially downward (below referred to as "the pendant state"; note that the outer side wall portion 26 is shown in the upright state in FIG. 5), about turning shafts 32 at both left and right sides or both front and rear sides thereof. The turning shafts 32 are disposed in the vicinities of portions at the lower edge side of the outer side wall portion 24 to 26 in the upright state shown in FIG. 1. Each turning shaft 32 shown in FIG. 2 and FIG. 3A to FIG. 3C may, in accordance with a displacement operation of an operation member 47, be displaced from an engaged state with an attachment member 52 shown in FIG. 2 and FIG. 3A through an intermediate state shown in FIG. 3B to a non-engaged state with the attachment member 52 shown in FIG. 3C. Opposite to the displacement operation described above, the turning shaft 32 may be returned to the engaged state by a return operation of the operation member 47 from the non-engaged state.

Figure 5:
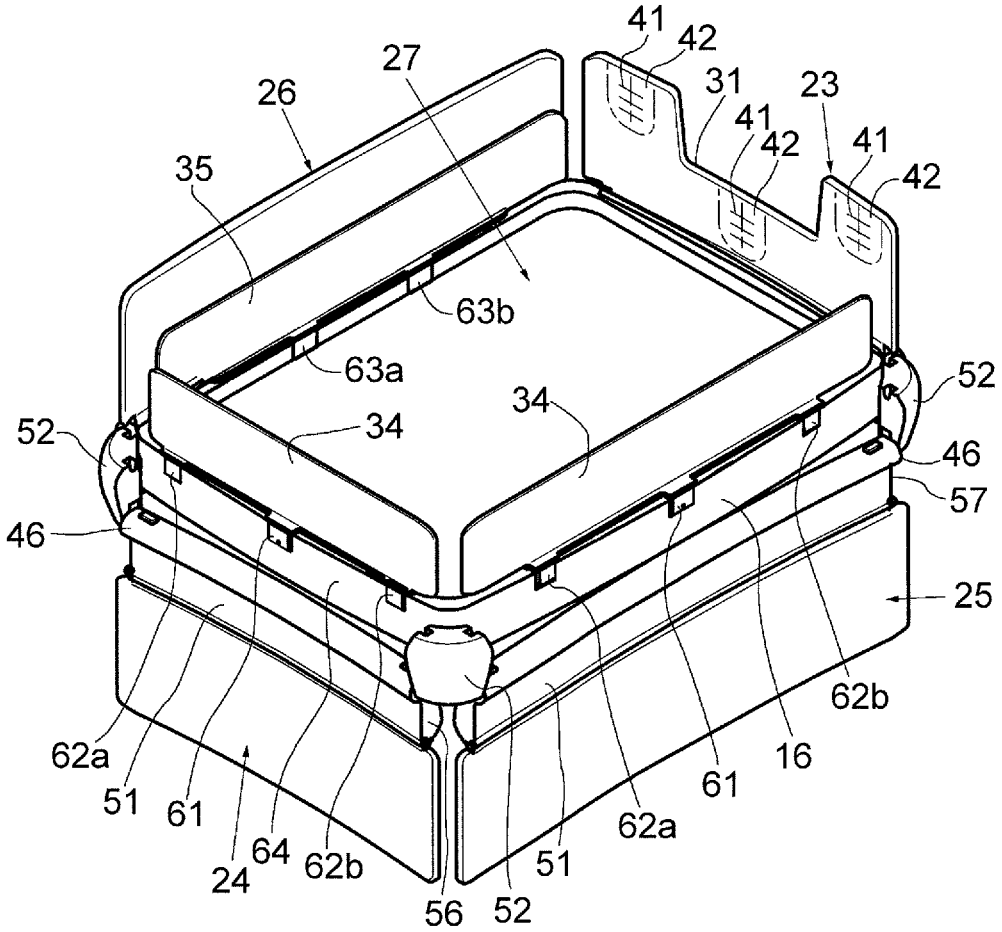
FIG. 5 is a perspective view of the child accommodation structure shown in FIG. 4 in a state in which front side and left side outer side wall portions are opened.

At the outer periphery of the mattress tray 16, as shown in FIG. 5, inner side wall portions (that is, guard wall portions or guard inner side wall portions) 33, 34 and 35 are provided along the outer periphery of the mattress tray 16 so as to form a substantial "U" shape overall as seen in plan view. Each of the inner side wall portions 33 to 35 may be substantially wholly structured in a resilient board shape of a substantially transparent plastic such as a substantially transparent polycarbonate resin, a substantially transparent acrylic resin or the like. The inner side wall portion (that is, guard wall portion or guard inner side wall portion) 33 at the leg side is removably (that is, detachably) attached to the mattress tray 16 so as to protrude substantially upward from a vicinity of a leg side end portion of the mattress tray 16. The inner side wall portions (that is, guard wall portions or guard inner side wall portions) 34 and 35 at the left side and the right side are removably (that is, detachably) attached to the mattress tray 16 so as to protrude substantially upward from vicinities of left side and right side end portions of the mattress tray 16.

As shown in FIG. 1 and FIG. 5, an appropriate number (three in this exemplary embodiment) of grommet members 42 may be attached to a region of the outer side wall portion 23 at which the recess portion 31 in the cutaway shape is provided and regions of the outer side wall portion 23 at both left and right sides of the region of the recess portion 31. Each grommet member 42 includes incisions 41 for cable retention. In states in which elongated members (not shown in the drawings) such as an oxygen supply tube and the like penetrate through the grommet members 42, the elongated members may be retained in the incisions 41. An infrared heater 43 is provided at an upper end portion of the accessory support pillar 22. Various measurement and control units 44 for body temperature, oxygen saturation and the like are provided at the accessory support pillar 22 so as to be disposed substantially between the infrared heater 43 and the child accommodation space 27 as seen from the front. Specifically, a body temperature control unit of the measurement and control units 44 may be configured to input signals from a body temperature probe that measures body temperature of a child and display the body temperature, and also to control a heating temperature of the infrared heater 43 and suchlike.

—2. Description of Outer Side Wall Portion Structures—

As shown in FIG. 1, FIG. 2, FIG. 5 and the like, each of the outer side wall portions 23 to 26 is provided with a wall portion main body 45 and a support member 46. A substantial lower end portion of the wall portion main body 45 is fixed to the support member 46 by screw-fixing or the like. Substantially the whole of an inner side face of the support member 46 at the substantial lower end portion of the wall portion main body 45 is covered by a cover member 51. As shown in FIG. 1 and FIG. 2, each outer side wall portion 23 to 26 is turnably attached to the attachment members 52 by a pair of the turning shafts 32 at vicinities of both left and right side end portions or vicinities of both front and rear side end portions of the lower end portion of the support member 46 of that outer side wall portion 23 to 26. The attachment members 52 are attached and fixed substantially at the four corners of the mattress tray 16. A pair of joining members 53 of each outer side wall portion 23 to 26 are detachably engaged with engagement receiving portions 54 of the attachment members 52 that are disposed at the two sides in the substantial horizontal direction of the outer side wall portion 23 to 26. As shown in FIG. 1, FIG. 2 and the like, a region of the wall portion main body 45 of the outer side wall portion 23 to 26 that is substantially adjacent above an upper side face of the support member 46 is structured as a reduced thickness portion 55 with a substantially triangular shape in sectional view. The reduced thickness portion 55 is provided along substantially the whole length of the outer side wall portion 23 to 26 substantially in the horizontal direction (that is, substantially in the length direction). In order to prevent contaminated water, dust and the like ingressing between the lower end portion of the wall portion main body 45 and the support member 46 and between the lower end portion of the wall portion main body 45 and the cover member 51, a lower end face of one of two side portions of the thickness direction of the reduced thickness portion 55 abuts against a substantial upper face of the support member 46, and a lower end face of the other side portion abuts against a substantial upper face of the cover member 51.

As shown in FIG. 1, FIG. 5 and the like, the outer side wall portion 23 may have substantially the same shape as the outer side wall portion 24 at the leg side, apart from the outer side wall portion 23 including the recess portion 31 in the cutaway shape and the grommet members 42. The outer side wall portion 25 at the left side and the outer side wall portion 26 at the right side may have substantially the same shapes as one another. In order to structure release portions for the four attachment members 52, cutaway portions 56 are provided at both end portions of the respective support members 46 of the outer side wall portions 23 to 26, at regions that correspond with the attachment members 52. Accordingly, each support member 46 is structured such that a length thereof in the substantially horizontal direction is somewhat shorter than the length of the wall portion main body 45 of the outer side wall portion 23 to 26 in the substantially horizontal direction. Cutaway portions 57 that communicate with the respective cutaway portions 56 are provided in vicinities of respective lower end portions in the upright state at both left and right sides or both front and rear sides of the wall portion main body 45 of the outer side wall portion 23 to 26. As shown in FIG. 1 and FIG. 4, each outer side wall portion 23 to 26 in the upright state is curved from the inner side toward the outer side thereof so as to protrude somewhat in an arc shape as viewed substantially in plan view. If the outer side wall portion 23 to 26 in the upright state is viewed substantially in plan view, a central portion in the length direction of the outer side wall portion 23 to 26 is substantially in a circular arc shape with a relatively large diameter (that is, a substantial circular arc shape with a relatively small rate of curvature), and each of two end portions of the outer side wall portion 23 to 26 in the length direction is substantially in a circular arc shape with a relatively small diameter (that is, a substantial circular arc shape with a relatively large rate of curvature). Thus, each outer side wall portion 23 to 26 forms a continuous curved surface that is substantially free of corner portions from one of the two end portions through the central portion to the other of the two end portions.

When any of the outer side wall portion 24 at the leg side and the outer side wall portions 25 and 26 at the left and right sides is to be turned down from the upright state shown in FIG. 1 to the pendant state illustrated for the outer side wall portions 24 and 25 in FIG. 5, locking of the outer side wall portion 24 to 26 by a locking unit that locks the outer side wall portion 24 to 26 in a turned up state (that is, the joining members 53 and engagement receiving portions 54 illustrated in FIG. 2) is released. Then, as necessary, a carer may turn down the outer side wall portion 24 to 26 from the upright state to the pendant state by turning the outer side wall portion 24 to 26 down about the pair of the turning shafts 32 illustrated in FIG. 2. The turning down of the outer side wall portion 24 to 26 may be slowed by a damping function of a damper (not shown in the drawings) that can regulate a turning speed of the turning down. Hence, when the outer side wall portion 24 to 26 in the pendant state is to be turned up to the upright state, it is sufficient for the carer to turn up the outer side wall portion 24 to 26 by hand about the pair of turning shafts 32 of the outer side wall portion 24 to 26. Respective upper ends of the outer side wall portions 24 to 26 in the upright state are higher than respective upper ends of the inner side wall portions 33 to 35. A difference in height H1 between the outer side wall portions and the inner side wall portions in a substantially vertical direction (see FIG. 1) is approximately 84.5 mm in the illustrated embodiment.

—3. Structural Description of Inner Side Wall Portion Structures—

Figure 6:
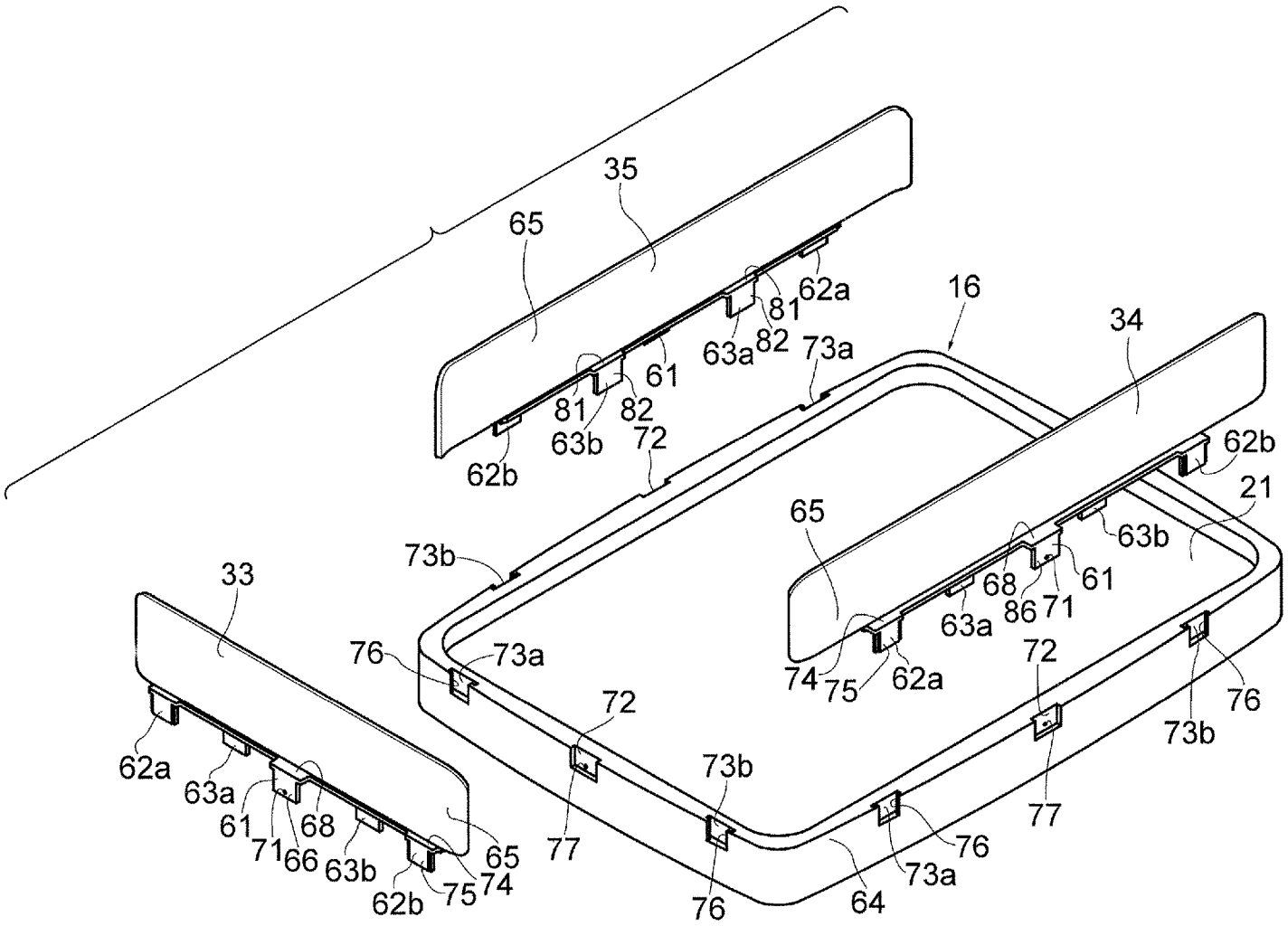
FIG. 6 is an exploded perspective view of the child accommodation structure shown in FIG. 4 in a state in which all of the front side, left side and right side inner side wall portions are removed from the mattress tray, showing none of the outer side wall portions.

As shown in FIG. 5 and FIG. 6, the inner side wall portion 33 at the leg side may extend over substantially the whole length of a vicinity of an end portion at the leg side of the mattress tray 16. The inner side wall portion 34 at the left side may extend over substantially the whole length of a vicinity of an end portion at the left side of the mattress tray 16. The inner side wall portion 35 at the right side may extend over substantially the whole length of a vicinity of an end portion at the right side of the mattress tray 16. Left and right end portions of the inner side wall portion 33 are separated from the respective front end portions of the inner side wall portions 34 and 35. Thus, the inner side wall portions 33 to 35 are structured as separate components. However, the left and right end portions of the inner side wall portion 33 may be connected with the front end portions of the inner side wall portions 34 and 35, in which case the inner side wall portions 33 to 35 may be structured overall as a single frame in a substantial "U" shape.

As shown in FIG. 5 and FIG. 6, each of the inner side wall portions 33 to 35 may be equipped with, for example, five attachment protrusion portions 61, 62*a*, 62*b*, 63*a* and 63*b* that protrude downward and are formed substantially in inverted "L" shapes. In specific terms, for example, the three attachment protrusion portions 61, 62*a* and 62*b* protrude downward from an outer side face of the inner side wall portion 33 to 35 and are provided by integral molding or the like. Meanwhile, for example, the two attachment protrusion portions 63*a* and 63*b* protrude downward from an inner side face of the inner side wall portion 33 to 35 and are provided by integral molding or the like. When the inner side wall portion 33 to 35 is mounted at a side wall portion 64 of the mattress tray 16, the protrusion portions 61, 62*a* and 62*b* of the inner side wall portion 33 to 35 abut against an outer side face of the side wall portion 64 of the mattress tray 16, and the protrusion portions 63*a* and 63*b* of the inner side wall portion 33 to 35 abut against an inner side face of the side wall portion 64 of the mattress tray 16. Therefore, the side wall portion 64 is nipped from the inner and outer sides thereof by the protrusion portions 61, 62*a* and 62*b* and the protrusion portions 63*a* and 63*b*. Thus, the inner side wall portions 33 to 35 are removably (that is, detachably) attached and fixed to the side face portions 64 of the mattress tray 16. Lower ends of the protrusion portions 61, 62*a*, 62*b*, 63*a* and 63*b* may touch against the mattress tray 16, but this contact is not particularly necessary; the protrusion portions 61, 62*a*, 62*b*, 63*a* and 63*b* need not touch against the mattress tray 16.

Figure 7:
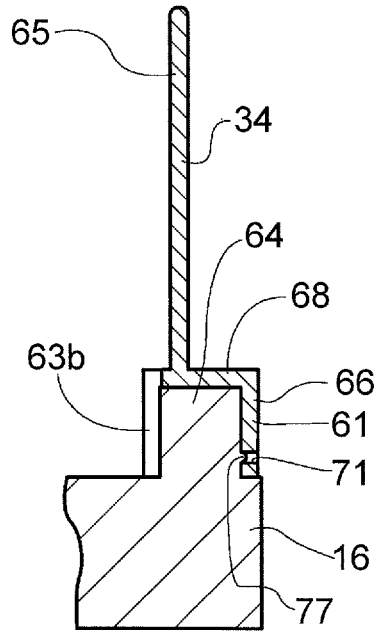
FIG. 7 is a vertical sectional diagram of a vicinity of a first attachment protrusion portion of an inner side wall portion shown in FIG. 6, showing a state in which the first attachment protrusion portion is engaged with the mattress tray.
Figure 11:
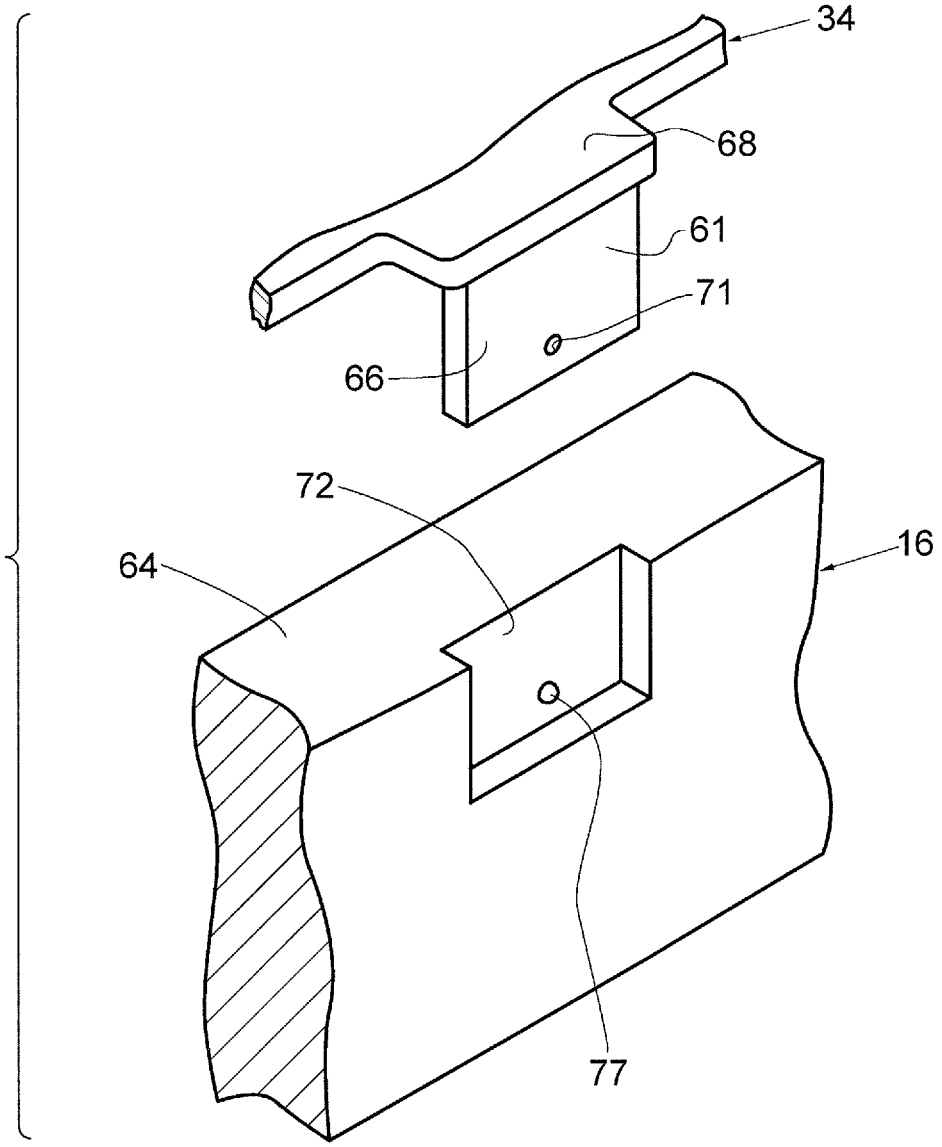
FIG. 11 is a magnified perspective view of the vicinity of the first attachment protrusion portion and a vicinity of a first attachment recess portion that are both shown in FIG. 6.

More specifically, as shown in FIG. 6, FIG. 7 and FIG. 11, the first attachment protrusion portion 61 has a substantial inverted "L" shape in cross section (that is, a substantially horizontal portion 68 and a substantially pendant portion 66). Each protrusion portion 61 may be formed integrally with an inner side wall portion main body 65 of the respective leg side, left side or right side inner side wall portion 33 to 35, substantially at a lower end of a substantially central portion in a length direction of the inner side wall portion main body 65. Alternatively, the protrusion portion 61 may be formed as a separate body from the inner side wall portion main body 65. A penetrating hole 71 or a recess portion is formed in the pendant portion 66 of the protrusion portion 61 to serve as an engaging hole portion. The penetrating hole 71 is formed in the illustrated embodiment. If the recess portion were formed, the recess portion would have to be formed at the inner side face of the protrusion portion 61. A first attachment recess portion 72 is formed in each of the outer side faces of the side wall portion 64 of the mattress tray 16 so as to oppose the respective attachment protrusion portion 61 of the leg side, left side or right side inner side wall portion 33 to 35. An engaging protrusion portion 77 that can engage with the penetrating hole 71 is protrudingly provided in each first attachment recess portion 72.

Figure 12:
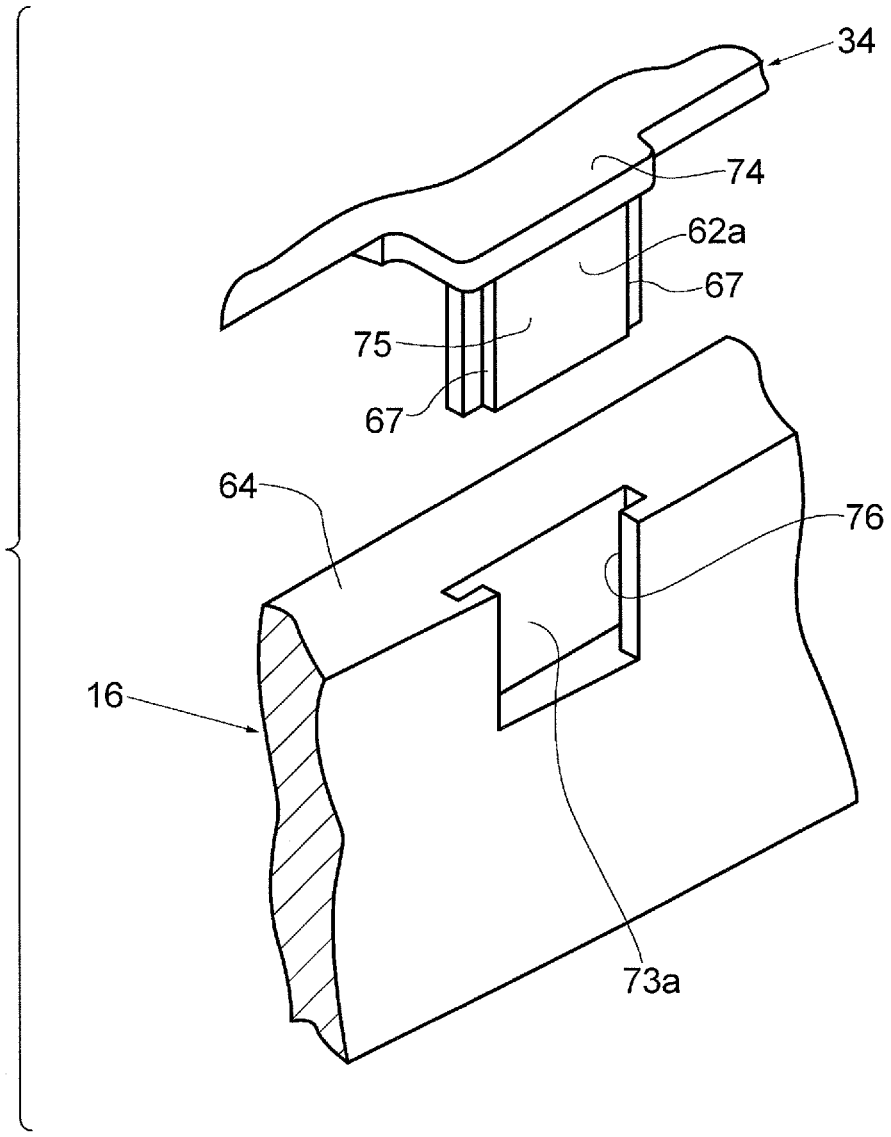
FIG. 12 is a magnified perspective view of the vicinity of the second attachment protrusion portion and a vicinity of a second attachment recess portion that are both shown in FIG. 6.

As shown in FIG. 6, FIG. 7 and FIG. 12, the second attachment protrusion portions 62*a* and 62*b* each have a substantial inverted "L" shape in cross section (that is, a substantially horizontal portion 74 and a substantially pendant portion 75). The protrusion portions 62*a* and 62*b* are formed in substantially the same manner as the protrusion portion 61 at both left and right sides or both front and rear sides in the length direction of the inner side wall portion main body 65 of the respective leg side, left side or right side inner side wall portion 33 to 35. A step portion 67 is formed at each of end portions at the left and right sides or front and rear sides of the pendant portion 75 of each of the protrusion portions 62*a* and 62*b*. Second attachment recess portions 73*a* and 73*b* are formed in each outer side face of the side wall portion 64 of the mattress tray 16 so as to correspond with the respective protrusion portions 62*a* and 62*b* of the leg side, left side or right side inner side wall portion 33 to 35. Narrowing portions 76 are formed at each of the second attachment recess portions 73*a* and 73*b* to substantially correspond with the pendant portion 75 of the respective protrusion portion 62*a* or 62*b*. Thus, each of the second attachment recess portions 73*a* and 73*b* is formed in substantially the same shape as the first attachment recess portion 72 apart from including the narrowing portions 76, which may prevent disengagement of the second attachment protrusion portion 62*a* or 62*b* from the second attachment recess portion 73*a* or 73*b*.

Figure 9:
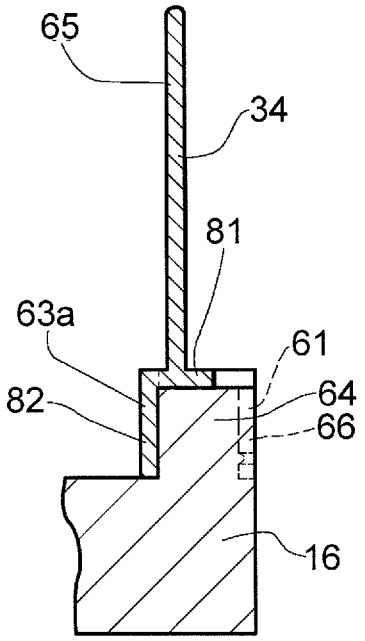
FIG. 9 is a vertical sectional diagram of a vicinity of a third attachment protrusion portion of the inner side wall portion shown in FIG. 6, showing a state in which the third attachment protrusion portion is engaged with the mattress tray.

As shown in FIG. 5, FIG. 6 and FIG. 9, the third attachment protrusion portions 63*a* and 63*b* each have a substantial inverted "L" shape in cross section (that is, a substantially horizontal portion 81 and a substantially pendant portion 82). The protrusion portions 63*a* and 63*b* may be formed at both left and right sides or both front and rear sides in the length direction of the inner side wall portion main body 65 of the respective leg side, left side or right side inner side wall portion 33 to 35 (specifically, at substantial middle positions between the attachment protrusion portion 61 and the attachment protrusion portions 62*a* and 62*b*). The substantially horizontal portion 81 of each protrusion portion 63*a* or 63*b* with the substantial inverted "L" shape in cross section abuts against an upper face of the side face portion 64. The pendant portion 82 of the protrusion portion 63*a* or 63*b* abuts against the inner side face of the side face portion 64 of the mattress tray 16.

—4. Description of Operations of the Inner Side Wall Portion Structures—

Figure 8:
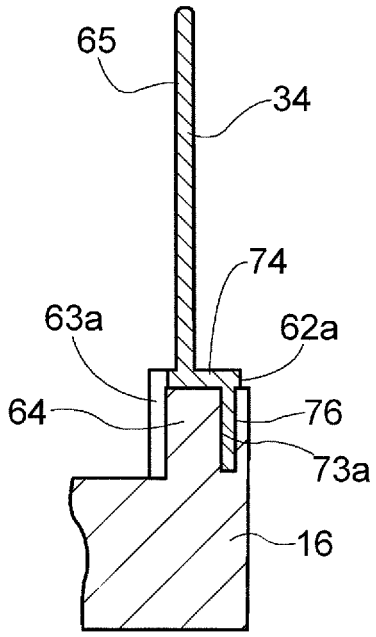
FIG. 8 is a vertical sectional diagram of a vicinity of a second attachment protrusion portion of the inner side wall portion shown in FIG. 6, showing a state in which the second attachment protrusion portion is engaged with the mattress tray.

When the inner side wall portions 33 to 35 are to be attached to a front side portion, left side portion and right side portion of the side wall portion 64 of the mattress tray 16, as shown in FIG. 5, it is sufficient to move each of the inner side wall portions 33 to 35 substantially downward from substantially above the mattress tray 16, as shown in FIG. 6. At this time, the first attachment protrusion portion 61 and second attachment protrusion portions 62*a* and 62*b* of each inner side wall portion 33 to 35 engage (that is, tightly fit) with the respective first attachment recess portion 72 and second attachment recess portions 73*a* and 73*b* as shown in FIG. 5, FIG. 7, FIG. 8 and the like. Correspondingly, the third attachment protrusion portions 63*a* and 63*b* of the inner side wall portion 33 to 35 abut against the respective front side portion, left side portion or right side portion of the side wall portion 64 of the mattress tray 16 as shown in FIG. 5, FIG. 9 and the like. Hence, the side wall portion 64 of the mattress tray 16 is nipped between the first and second attachment protrusion portions 61, 62*a* and 62*b* and the third attachment protrusion portions 63*a* and 63*b* of the inner side wall portion 33 to 35. Thus, the inner side wall portion 33 to 35 is attached and fixed to the side wall portion 64.

More specifically, as shown in FIG. 7, the first attachment protrusion portion 61 of the inner side wall portion 33 to 35 is abutted against both the upper face and the outer side face (that is, a side face of the first attachment recess portion 72) of the side wall portion 64. At this time, the engaging protrusion portion 77 of the first attachment recess portion 72 of the mattress tray 16 relatively engages with the penetrating hole 71 of the first attachment protrusion portion 61. Meanwhile, the second attachment protrusion portions 62*a* and 62*b* of the inner side wall portion 33 to 35 engage with the respective second attachment recess portions 73*a* and 73*b* into a state in which disengagement, toward the right of FIG. 8, is blocked by the narrowing portions 76. In addition, the third attachment protrusion portions 63*a* and 63*b* of the inner side wall portion 33 to 35 abut against the inner side face of the side wall portion 64. Thus, each of the inner side wall portions 33 to 35 may be accurately and reliably attached to the mattress tray 16 as shown in FIG. 5 and the like.

In a state in which a child such as a neonatal infant or the like is rested on the mattress 21 that is disposed on the mattress tray 16 as shown in FIG. 5, the child may push the inner side face of, for example, the inner side wall portion 34 at the left side outward or diagonally outward with a hand or foot. However, because the second attachment recess portions 73*a* and 73*b* of the mattress tray 16 each include the narrowing portions 76, displacement of the front and rear pair of second attachment protrusion portions 62*a* and 62*b* of the inner side wall portion 34 toward the outer side of the mattress tray 16 is blocked. Moreover, displacement of the inner side wall portion main body 65 toward the outer side of the mattress tray 16 is even more excellently blocked by the pendant portions 82 strongly abutting against the inner side face of the side wall portion 64. At the same time, because the protrusion portion 77 provided at the first attachment recess portion 72 of the mattress tray 16 is engaged with the penetrating hole 71 of the inner side wall portion 34, substantially upward displacement of the first attachment protrusion portion 61 of the inner side wall portion 34 is also blocked. Thus, even when the child pushes the inner side face of the inner side wall portion 34 at the left side outward or pushes the same diagonally upward and outward, there is no particular risk of the inner side wall portion 34 at the left side being moved outward or diagonally outward by the child.

Figure 10:
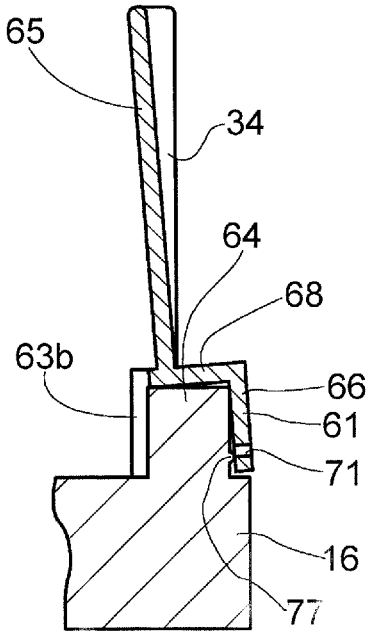
FIG. 10 is a vertical sectional diagram of the vicinity of the first attachment protrusion portion shown in FIG. 7, showing a state in which the engagement of the first attachment protrusion portion with the mattress tray has started to disengage.

When, for example, the inner side wall portion 34 of the inner side wall portions 33 to 35 is to be detached from the mattress tray 16, as shown in FIG. 6 and the like, it is sufficient for a carer to grip a vicinity of a central portion in the length direction of the inner side wall portion main body 65 of the inner side wall portion 34 (that is, a region approximately above the first attachment protrusion portion 61) with their hand and then, as shown in FIG. 10, tilt the inner side wall portion 34 a little toward the inner side. At this time, the engaging protrusion portion 77 of the mattress tray 16 is relatively disengaged from the penetrating hole 71 of the inner side wall portion 34. Thus, the inner side wall portion 34 may be detached from the mattress tray 16 by the inner side wall portion main body 65 being pulled substantially upward. In this detachment, the second attachment protrusion portions 62*a* and 62*b* of the inner side wall portion 34 may be detached from the second attachment recess portions 73*a* and 73*b* of the mattress tray 16 at the same time. The pendant portions 82 are simply pressed substantially toward the inner side by the side wall portion 64. Therefore, there is no particular risk of breakage occurring in the detachment.

Hereabove, an exemplary embodiment of the present invention has been described in detail, but the present invention is not limited by this exemplary embodiment. Numerous modifications and improvements may be applied in accordance with the gist of the invention recited in the claims.

For example, in the exemplary embodiment described above, the present invention is applied to an open-type incubator. However, as well as open-type incubators, the present invention may be applied to closed-type incubators, combined-use closed- and open-type incubators, and the like. If the present invention is applied to a combined-use closed- and open-type incubator as described above, a substantially box lid-shaped canopy hood that selectively covers the child accommodation space 27 from above and that may be moved substantially up and down may be provided at the combined-use closed- and open-type incubator. This canopy hood may be structured by a canopy portion, which may be substantially transparent, and outer side wall portions, which may project substantially downward from periphery vicinities of the canopy portion, may be substantially transparent, and may form a substantially rectangular shape as seen in plan view. A structure may be employed in which, when the canopy hood has been raised, the incubator serves as an open-type incubator in accordance with the upper face of the child accommodation space 27 being opened up, and when the canopy hood has been lowered, the incubator serves as a closed-type incubator in accordance with the upper face of the child accommodation space 27 being closed off by the canopy hood.

In the exemplary embodiment described above, the mattress tray 16 is formed in a substantially rectangular shape as seen in plan view. However, the mattress tray 16 seen in plan view may be formed in a substantially circular shape, a substantially ellipsoid shape, a substantially oval shape or the like, and the mattress tray 16 seen in plan view may be formed in a substantially polygonal shape other than a substantially rectangular shape or the like.

In the exemplary embodiment described above, the penetrating hole 71 is provided at the first attachment protrusion portion 61 and the engaging protrusion portion 77 is provided at the first attachment recess portion 72. However, the engaging protrusion portion 77 may be provided at the first attachment protrusion portion 61 and a recess portion corresponding with the penetrating hole 71 may be provided at the first attachment recess portion 72.

In the exemplary embodiment described above, The three inner side wall portions 33 to 35 are provided to serve as the inner side wall portions. In addition to the three inner side wall portions 33 to 35 at the leg side, right side and left side, an inner side wall portion at the head side may be provided as necessary.

What is claimed is:

1. An incubator comprising:

a mattress tray having an upper surface on which a child can be rested, the mattress tray comprising a peripheral ridge elevated from the upper surface of the mattress tray so as to delineate an outer periphery of the mattress tray; and guard walls provided to stand upward from the peripheral ridge and surround the outer periphery of the mattress tray, wherein the guard walls each has (i) a width extending along a side of the upper surface of the mattress tray, (ii) a thickness extending between outer and inner surfaces of the guide wall in perpendicular to the side of the upper surface of the mattress tray and (iii) a height extending in perpendicular to the upper surface of the mattress tray, wherein one of the guard walls comprises a lower surface, a first attachment protrusion protruding downward from the lower surface in a direction of the height of said one of the guard walls, and a second attachment protrusion protruding downward from the lower surface in the same direction in which the first and second attachment protrusions being separated from each other along the width of said one of the guard walls and along the thickness thereof, wherein the first and second attachment protrusions are configured to hold the peripheral ridge between them in a thickness direction of the peripheral ridge, the peripheral ridge of the mattress tray comprises an upper surface, and a first attachment recess formed in the upper surface of the peripheral ridge of the mattress tray in the direction of the height of said one of the guard walls, the first attachment protrusion being detachably engaged in the first attachment recess, and one of the first attachment protrusion or the first attachment recess comprises an engaging pin, and the other of the first attachment protrusion or the first attachment recess comprises an engaging hole for receiving the engaging pin to hold engagement of the first attachment protrusion and the first attachment recess.

2. The incubator according to claim 1, wherein the guard walls comprising a first guard wall standing along a front side of the mattress tray, a second guard wall standing along a left side of the mattress tray and a third guard wall standing along a right side.

3. The incubator according to claim 2, further comprising outer peripheral walls provided to surround the guard walls, wherein at least one of the outer peripheral walls is configured to turn between an upright position and an right down position.

4. The incubator according to claim 1, wherein said one of the guard walls comprises two first attachment protrusions, and the peripheral ridge comprises two first attachment recesses.

5. The incubator according to claim 1, wherein the first attachment recess is formed in an outer side face of the peripheral ridge of the mattress tray.

6. The incubator according to claim 1, wherein the first attachment recess is formed in the peripheral ridge in a shape of a hole having a narrowing portion, the first attachment recess has a recess width in the direction of the width of said one of the guide walls, and the narrowing portion has a width in the direction of the width of said one of the guide walls, wherein the width of the narrowing portion is narrower than the recess width.

7. The incubator according to claim 1, wherein the second attachment protrusion is positioned in contact with an inner surface of the peripheral ridge so that the first and second attachment protrusions hold the peripheral ridge between them.

8. The incubator according to claim 7, wherein said one of the guard walls comprises two second attachment protrusions.

9. The incubator according to claim 1, wherein the first attachment recess is formed in a configuration of a groove in an outer surface of the peripheral ridge in a height direction of the peripheral ridge, the groove being open in the upper surface of the peripheral ridge so that the first attachment protrusion can be inserted in the groove from the upper surface of the peripheral ridge.

10. The incubator according to claim 1, wherein said one of the guard walls stands upward from the upper surface of the peripheral ridge, with the width of said one of the guard walls extending on the upper surface along a length of the peripheral ridge, wherein said one of the guard walls extends along a line on the upper surface that runs closer to the outer surface of the peripheral ridge than to the inner surface thereof.

* * * * *